US011259991B2

(12) United States Patent
Moran

(10) Patent No.: US 11,259,991 B2
(45) Date of Patent: Mar. 1, 2022

(54) CONTAINER GRIPPING AID

(71) Applicant: Ollwyn Agnes Moran, Dublin (IE)

(72) Inventor: Ollwyn Agnes Moran, Dublin (IE)

( * ) Notice: Subject to any disclaimer, the term of this patent is extended or adjusted under 35 U.S.C. 154(b) by 0 days.

(21) Appl. No.: 17/063,506

(22) Filed: Oct. 5, 2020

(65) Prior Publication Data

US 2021/0015712 A1 Jan. 21, 2021

Related U.S. Application Data

(62) Division of application No. 15/573,698, filed as application No. PCT/EP2016/060576 on May 11, 2016, now Pat. No. 10,792,227.

(30) Foreign Application Priority Data

May 11, 2015 (IE) ..... 2015/0144

(51) Int. Cl.
*A61J 9/06* (2006.01)

(52) U.S. Cl.
CPC ..... *A61J 9/0623* (2015.05); *A61J 9/0669* (2015.05)

(58) Field of Classification Search
CPC .... A61J 9/08; A61J 9/06; A47G 23/02; A47G 23/0241; B65D 23/001; B65D 23/0871; B65D 25/20; B65D 81/022; B65D 81/03; B65D 81/3876
USPC ..... 215/11.1, 11.6, 12.1, 395, 393, 384; 220/903, 737, 23.91, 920; 248/102; D7/624.2, 607
See application file for complete search history.

(56) References Cited

U.S. PATENT DOCUMENTS 995,700 A * 6/1911 Maynard ..... B65D 23/001 215/12.1
1,020,269 A * 3/1912 Domnick ..... B65D 23/001 215/12.1
1,188,904 A * 6/1916 Cosgriff ..... B65D 23/001 215/12.1
1,319,297 A * 10/1919 Limacher ..... A61J 9/00 215/11.1
1,429,198 A * 9/1922 Fawcett ..... A61J 9/08 215/11.6

(Continued)

FOREIGN PATENT DOCUMENTS

AU 2016260820 1/2018
AU 2020289771 1/2021

(Continued)

OTHER PUBLICATIONS

International Search Report and Written Opinion issued for Application No. PCT/EP2016/060576 dated Oct. 5, 2016. 14 pages.

(Continued)

*Primary Examiner* — Chun Hoi Cheung
*Assistant Examiner* — Brijesh V. Patel
(74) *Attorney, Agent, or Firm* — Middleton Reutlinger

(57) ABSTRACT

A container gripping aid (1) has a jacket (2) for reception of a container such as a baby bottle (3). The jacket (2) has a mesh configuration with a plurality of through-holes (5) to facilitate gripping of the jacket (2) by a baby. The jacket (2) has an egg-like shape. Thus, when it is engaged with the bottle (3), most of the jacket (2) side wall is supported spaced-apart from an exterior side wall (6) of the container (3) which enables a baby to easily grip the mesh of the jacket (2).

10 Claims, 6 Drawing Sheets

(56) References Cited

U.S. PATENT DOCUMENTS 1,626,425 A * 4/1927 Pelsue ..... A61J 9/08 215/11.6
1,690,509 A * 11/1928 Thoreson ..... A61J 9/08 215/11.6
2,115,654 A * 4/1938 Swofford ..... B65D 81/3876 215/12.1
2,310,515 A * 2/1943 Chester ..... A61J 9/06 215/12.1
2,500,786 A * 3/1950 Austin ..... A61J 9/08 215/12.1
2,706,571 A * 4/1955 Ryan ..... A61J 9/08 215/12.1
3,058,708 A * 10/1962 Murray ..... A61J 17/02 248/102
3,918,920 A * 11/1975 Barber ..... B01L 9/06 422/560
4,514,995 A * 5/1985 Curtis ..... A47G 23/03 66/170
4,941,579 A * 7/1990 Lee ..... A61J 9/0623 215/11.1
5,152,709 A * 10/1992 Johnson, III ..... A63H 33/18 215/12.1
D351,971 S * 11/1994 Cappola ..... A63B 43/002 D7/606
5,460,368 A * 10/1995 Pearson ..... A63B 43/002 473/597
5,513,885 A * 5/1996 Joffe ..... A61J 9/0623 215/396
5,687,874 A * 11/1997 Omori ..... B65D 25/101 220/737
5,921,431 A * 7/1999 Pych ..... A47G 23/0241 220/742
D431,735 S * 10/2000 Sullivan ..... F25D 3/08 D6/515
D516,872 S * 3/2006 Rigberg ..... F25D 3/08 D7/619.1
7,118,005 B2 * 10/2006 Shimazaki ..... F25D 3/08 220/737
7,337,915 B1 * 3/2008 Weldon ..... A47G 23/0225 220/483
D580,775 S * 11/2008 Harris ..... A61J 9/0623 D9/668
D585,558 S * 1/2009 Feeley ..... A61J 9/0623 D24/199
7,712,625 B2 * 5/2010 Alger ..... A47G 23/0313 220/737
D618,065 S * 6/2010 Joy ..... A47G 23/0225 D7/624.2
D621,259 S * 8/2010 Joy ..... F25D 3/08 D9/444
D629,259 S * 12/2010 Joy ..... A47G 23/0241 D7/624.2
D635,685 S * 4/2011 Hendricks ..... B65D 25/101 D24/199
8,152,012 B1 * 4/2012 Berglund ..... A61J 9/0623 215/396
D690,376 S * 9/2013 Silverglate ..... A61J 9/0623 D21/712
D700,806 S * 3/2014 Joy ..... A61J 17/02 D7/507
D701,091 S * 3/2014 Joy ..... B65D 23/001 D7/624.2
D707,087 S * 6/2014 Joy ..... A61J 9/08 D7/624.2
8,998,029 B1 * 4/2015 Hausman ..... A61J 11/00 220/737
D752,765 S * 3/2016 Taylor ..... A61J 9/08 D24/197
D781,113 S * 3/2017 Kocsis ..... A61J 9/00 D7/624.2
9,924,817 B1 * 3/2018 Winter ..... A47G 23/0241
D848,799 S * 5/2019 Appelbaum ..... B65D 23/001 D7/624.2
D863,895 S * 10/2019 Pearce ..... B65D 23/001 D7/624.2
D886,309 S * 6/2020 Esnard ..... B65D 23/001 D24/199
D898,525 S * 10/2020 Boroski ..... B65D 23/001 D7/624.2
2010/0056310 A1 * 3/2010 Silverglate ..... A61J 9/0623 473/612
2010/0224585 A1 * 9/2010 Feeley ..... B65D 25/20 215/11.1
2011/0198310 A1 * 8/2011 Deitelbaum ..... B65D 23/0885 215/12.1
2012/0085772 A1 * 4/2012 Crosier ..... B65D 81/3804 220/737
2012/0104010 A1 * 5/2012 Kelley ..... B67C 3/14 220/737
2013/0020317 A1 * 1/2013 Martin ..... A61J 9/08 220/23.91
2014/0034660 A1 * 2/2014 Marcus ..... B65D 81/03 220/703
2014/0332440 A1 * 11/2014 Marcus ..... A47G 23/02 206/591
2015/0250684 A1 * 9/2015 Cross ..... A61J 9/06 206/459.1
2015/0342382 A1 * 12/2015 D'Alesio ..... A47G 23/0216 220/739
2015/0359366 A1 * 12/2015 Yan ..... A47G 23/0216 215/395

FOREIGN PATENT DOCUMENTS

| | | |
|---|---|---|
| CA | 3023759 | 11/2016 |
| CN | 2120582 | 11/1992 |
| CN | 101129293 | 7/2014 |
| CN | 203736554 | 7/2014 |
| CN | 108337877 A | 7/2018 |
| CN | 108337877 B | 3/2021 |
| CN | 113018198 | 6/2021 |
| DK | 3294257 | 1/2021 |
| EP | 3294257 A1 | 3/2018 |
| EP | 3294257 B1 | 10/2020 |
| IE | 20160128 | 1/2017 |
| IE | S86803 | 5/2017 |
| JP | 2018518248 | 7/2018 |
| KR | 20180040520 | 4/2018 |
| TW | 201023851 | 7/2010 |
| WO | 9818428 | 5/1998 |
| WO | 2016180887 | 11/2016 |

OTHER PUBLICATIONS

Australian Government, IP Australia: Examination Report issued for Application No. 2016260820 dated Dec. 16, 2019. 4 pages.
China Intellectual Property Office: Notification of Grant Patent Righ issued for Application No. 201680037945.8 dated Dec. 17, 2020. 2 pages.
Australian Government, IP Australia: Examination Report issued for Application No. 2020289771 dated Oct. 19, 2021. 4 pages.
European Patent Office: Intention To Grant issued for Application No. 16727636.9 dated Jan. 1, 2020. 5 pages.
China Intellectual Property Office: First Office Action issued for Application No. 201680037945.8 dated Mar. 25, 2020. 9 pages.

* cited by examiner

CONTAINER GRIPPING AID

BACKGROUND

This invention relates to a container gripping aid and in particular to a device for mounting on a baby bottle to facilitate gripping and holding of the baby bottle by a baby for feeding.

Various holding devices for baby bottles have previously been proposed and examples are to be found in U.S. Pat. Nos. 8,998,029, 8,152,012, 5,513,885, 4,941,579 and 3,058,708. These documents all essentially show devices which engage with the baby bottle and provide outwardly projecting handles which, for a baby, are more easily gripped than the bottle itself. While these devices do provide improved grip for the baby, they are not entirely satisfactory.

The present invention is directed towards providing an improved container gripping aid, in particular for a baby bottle.

SUMMARY

According to the invention there is provided a container gripping aid, including:

a jacket for reception, of the container;

retaining means for securing the jacket in engagement with the container; and the jacket having means for gripping the jacket to support the container.

In one embodiment of the invention, the jacket has a plurality of perforations or holes to provide the gripping means.

In another embodiment, the jacket has a mesh configuration. Thus, advantageously, the jacket can be readily easily gripped at any location.

In another embodiment, the mesh configuration is formed by a plurality of substantially circular holes in the jacket.

In another embodiment, the jacket is resiliently deformable.

In another embodiment, the jacket is formed by a stiff, but flexible material. That is the jacket is stiff enough to naturally hold its shape, but will at the same time easily deform when handled or gripped. In this regard, thermoplastic elastomers are particularly suitable for forming the jacket.

In another embodiment, the jacket has a somewhat bulbous or egg-like shape. Thus, when it is engaged with the container, a central portion of the jacket, intermediate the top and bottom of the jacket, is supported spaced-apart from an exterior of the container. This conveniently facilitates the user in gripping the jacket.

In a further embodiment, the jacket is sufficiently see-through to allow a container within the jacket to be viewed when the jacket is mounted on the container.

In another embodiment, the retaining means includes a clamp at a top of the jacket.

In another embodiment, the clamp comprises a pair of resiliently deformable opposed clamp arms.

In another embodiment, the clamp arms curve inwardly at a top of the jacket.

In another embodiment, the retaining means further includes an inwardly extending base support at a bottom of the jacket.

In another embodiment, the base support comprises an opposed pair of support arms which project inwardly at the bottom of the jacket.

In another embodiment, each support arm extends inwardly and upwardly at the bottom of the jacket.

In another embodiment, each base support arm is resiliently deformable.

In another embodiment, the jacket is adapted for mounting on a baby bottle.

In a further embodiment, the clamp arms are engagable with a shoulder at a top of the baby bottle and the base support arms are engagable with a base of the baby bottle extending in under the base of the baby bottle. Thus, essentially the whole bottle is substantially encased in the jacket.

In another embodiment complementary interengagable formations are provided on the jacket and on an associated container for releasable interengagement of the jacket and the container.

In another embodiment a bottom of the jacket is shaped for reception of the bottom of the container.

In another embodiment a rib or groove is provided on an exterior of the container or engagement with a complementary rib or groove on the jacket.

In another embodiment an inwardly directed rib is provided at an upper rim of the jacket for engagement with an associated groove on the container. Conveniently the groove is provided adjacent a rim of the container.

In another embodiment the jacket has inwardly directed spacer ribs on an inner wall of the jacket to maintain a side wall of the jacket spaced-apart from the container in use.

BRIEF DESCRIPTION OF THE DRAWINGS

The invention will be more clearly understood by the following descriptions of some embodiments thereof, given by way of example only, with reference to the accompanying drawings, in which.

DETAILED DESCRIPTION

Figure 7:
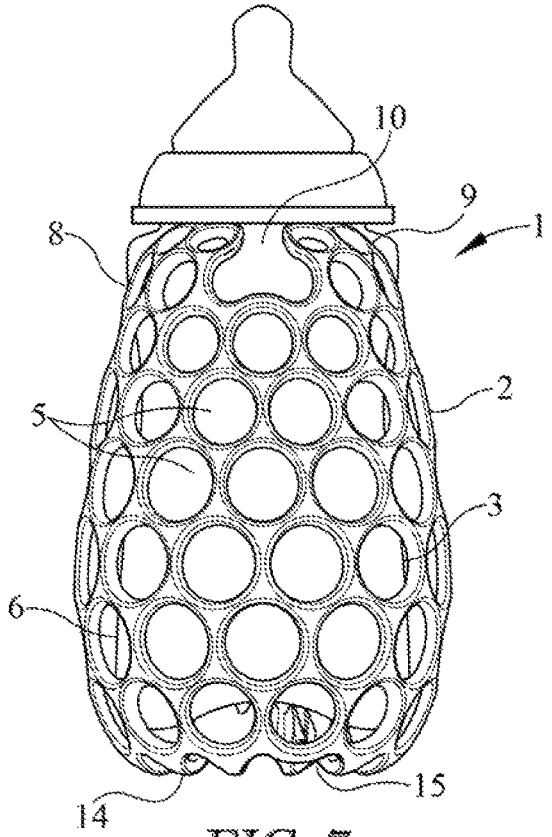
FIG. 7 is an elevational view showing the container gripping aid in use mounted on a baby bottle.
Figure 8:
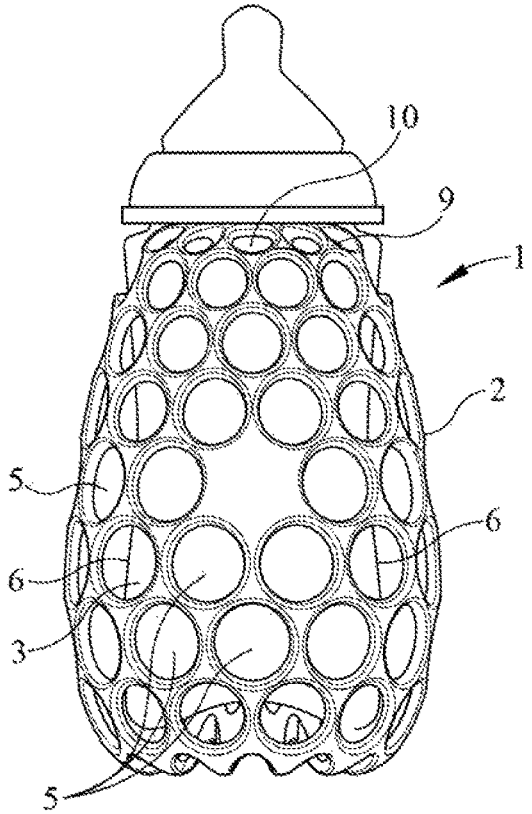
FIG. 8 is an end elevational view of the container gripping aid mounted on the baby bottle.
Figure 9:
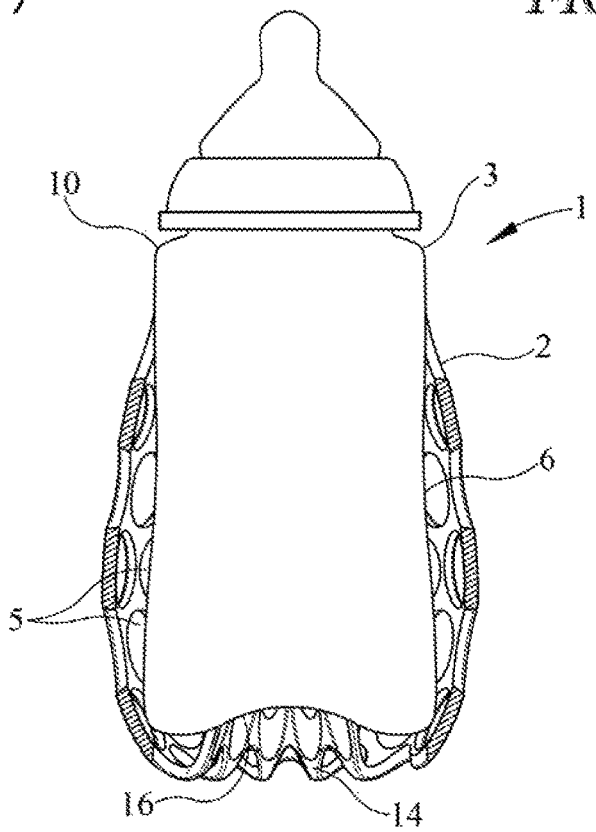
FIG. 9 is a sectional elevational view showing the container gripping aid mounted on the baby bottle.

Referring to the drawings, there is illustrated a container gripping aid according to the invention indicated generally by the reference numeral 1. The container gripping aid 1 has a jacket 2 for reception of a container such as a baby bottle 3 as shown in FIGS. 7 to 9. The jacket 2 has a mesh configuration with a plurality of circular through-holes 5 to facilitate gripping of the jacket 2 by a baby.

The jacket 2 has an egg-like shape. Thus, when it is engaged with the bottle 3, most of a side wall of the jacket 2 is supported spaced-apart from an exterior side wall 6 of the container 3 as best seen in FIG. 9. This enables a baby to easily grip the mesh of the jacket 2 and thus handle and support the bottle 3.

Figure 1:
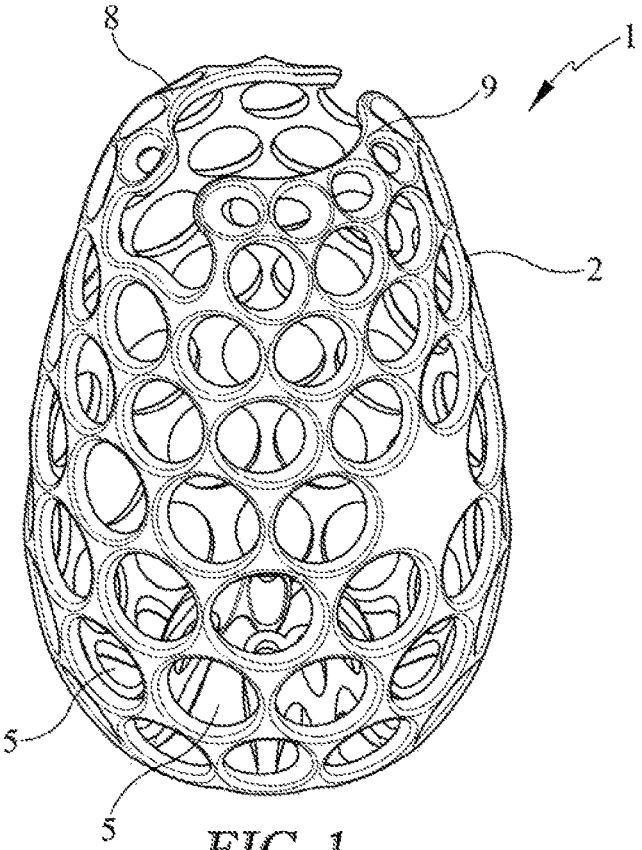
FIG. 1 is a perspective view of a container gripping aid according to the invention.
Figure 2:
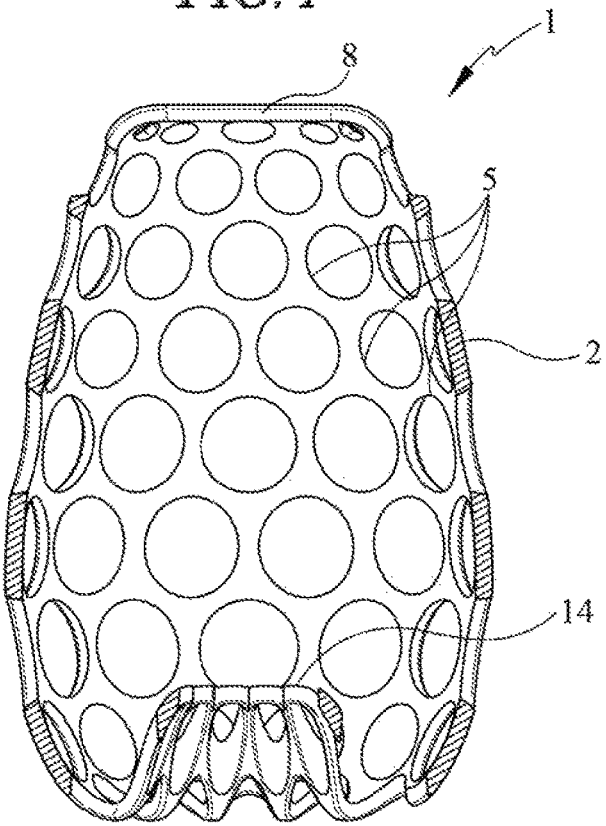
FIG. 2 is a sectional elevational view of the container gripping aid.
Figure 5:
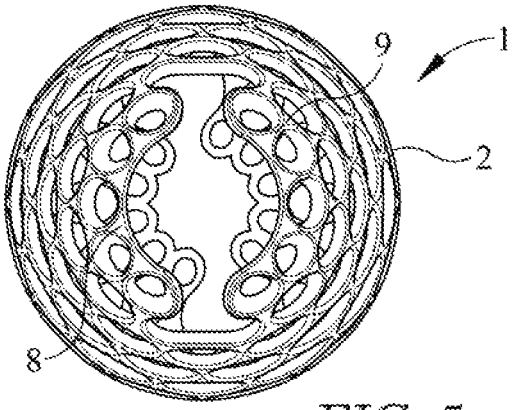
FIG. 5 is a plan view of the container gripping aid.
Figure 3:
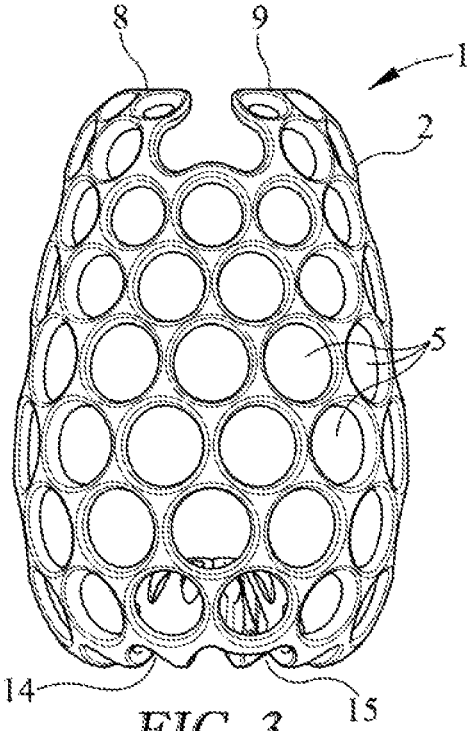
FIG. 3 is an elevational view of the container gripping aid.

The jacket 2 engages with a top and with a bottom of the bottle 3 to securely retain the jacket 2 on the bottle 3. A pair of resiliently deformable opposed clamp arms 8, 9 at a top of the jacket 2 move apart sufficiently to allow through-passage of the bottle 3 and then resiliently clamp against a shoulder 10 at a top of the bottle 3. It will be noted from FIG. 3 and FIG. 7 that these clamp arms 8, 9 curve inwardly at a top of the jacket 2 and snugly fit over and clamp against the shoulder 10 at the top of the bottle 3.

At a lower end of the jacket 2 an opposed pair of resiliently deformable support arms 14, 15 project inwardly and upwardly at a bottom of the jacket 2 for engagement with a base 16 of the bottle 3.

Preferably the jacket 2 is formed from a stiff but flexible material such as a thermoplastic elastomer, so it will naturally hold its shape, but will also readily easily deform to facilitate gripping the jacket 2.

It will be noted that the mesh of the jacket 2 is sufficiently open to be see-through and allow the contents of the bottle 3 to be viewed. The holes 5 or perforations in the jacket 2 forming the mesh may be of any suitable shape.

Figure 4:
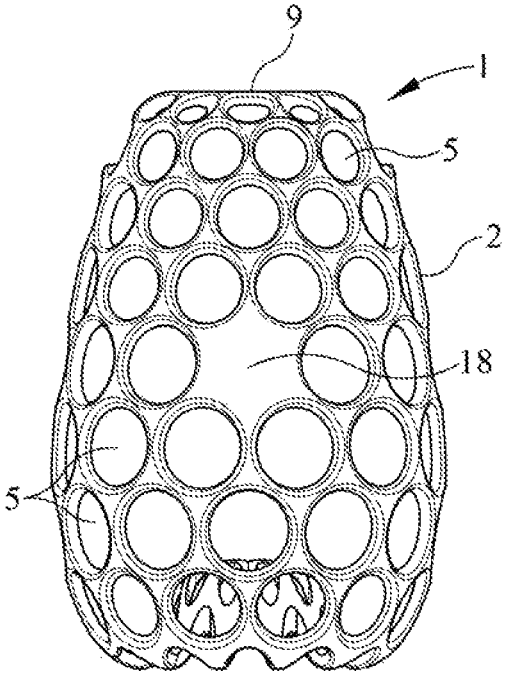
FIG. 4 is an end elevational view of the container gripping aid.
Figure 6:
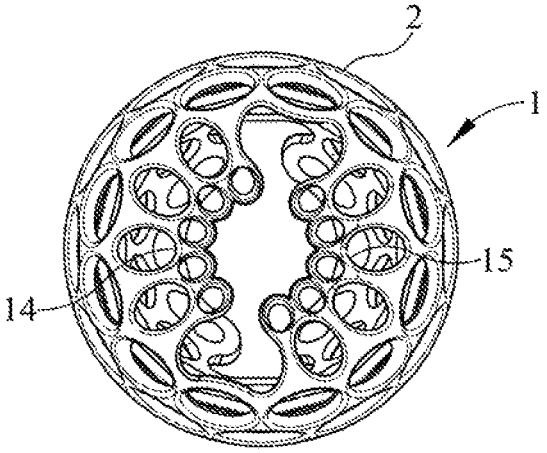
FIG. 6 is an underneath plan view of the container gripping aid.

While the jacket 2 has a plurality of perforations or holes 5 substantially throughout the jacket 2, a solid panel 18 (FIG. 4) for carrying a logo or the like may be provided on the jacket 2.

In use, a baby bottle 3 can be inserted into the jacket 2 of the container gripping aid 1 as shown in FIGS. 7 to 9. The clamp arms 8, 9 at a top of the jacket 2 embrace and grip the shoulder 10 at a top of the bottle 3 and the support arms 14, 15 at a bottom of the jacket 2 project inwardly and upwardly against the base 16 of the bottle 3 to securely retain the bottle 3 within the jacket 2. It will be noted that substantially all the side wall of the jacket 2 is held spaced-apart from an exterior side wall 6 of the bottle 3 and thus a baby can readily easily grip the jacket 2 at any position from top to bottom of the bottle 3 around the whole exterior of the bottle 3.

While the embodiment of the invention previously described herein is concerned with providing a container gripping aid for a baby bottle, it is envisaged that the container gripping aid of the invention may also be used with other bottles and other containers where it is desirous to make such containers easier to grip for whoever is likely to be using the container. For example, many elderly people, or invalids have limited grip strength and thus the container gripping aid of the invention may be of benefit to them in holding various containers for drinks and the like.

It will be appreciated that the container gripping aid of the invention is easy to fit onto and remove from a bottle or other container and is also readily easily cleaned as required.

Figure 14:
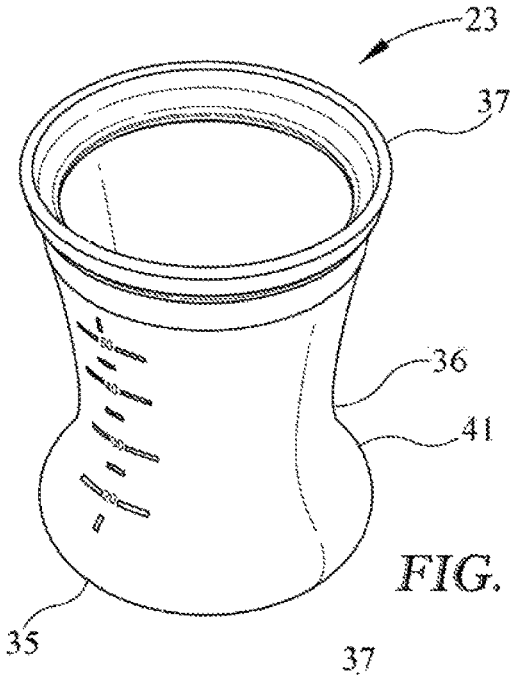
FIG. 14 is a perspective view of a cup for use with the container gripping aid of FIG. 10.
Figure 15:
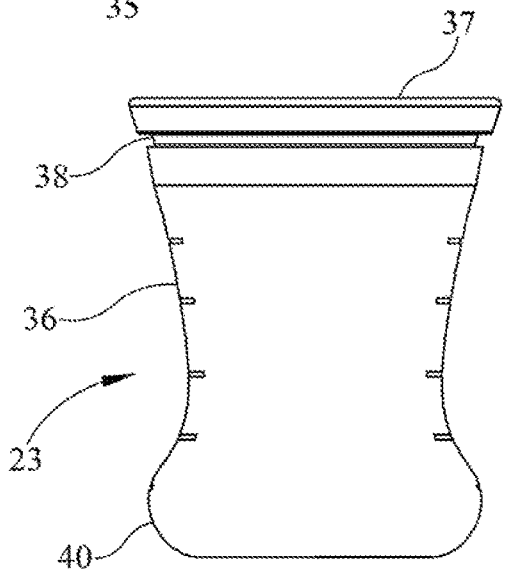
FIG. 15 is a front elevational view of the cup of FIG. 14.
Figure 16:
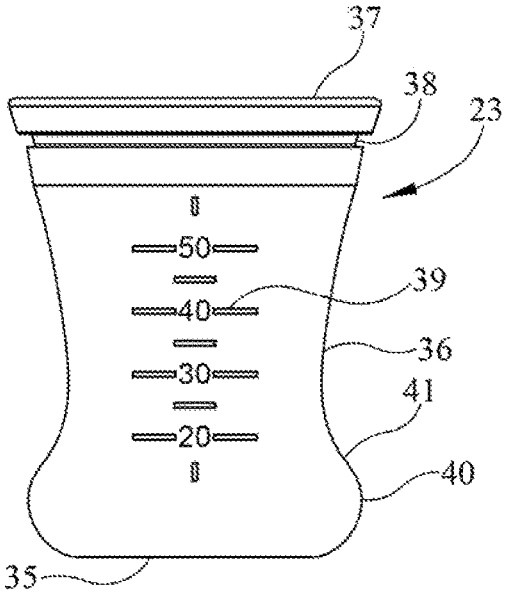
FIG. 16 is a side elevational view of the cup of FIG. 14.
Figure 17:
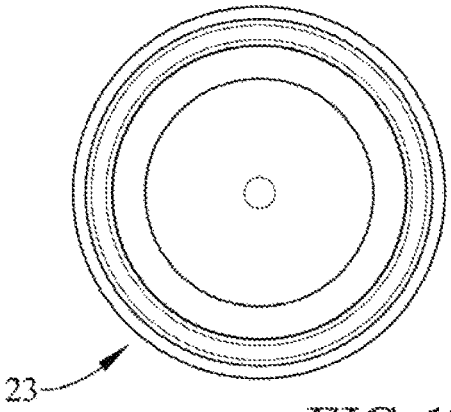
FIG. 17 is an underneath plan view of the cup of FIG. 14.

Referring now to FIGS. 10 to 20, there is shown another container gripping aid according to a second embodiment of the invention, indicated generally by the reference numeral 20. This is largely similar to the container gripping aid described previously, however in this case the gripping aid 20 comprises a jacket 22 for reception of a container comprising an associated cup 23 (FIG. 14). The jacket 22 has a mesh configuration side wall 24 with a plurality of through holes 25 to facilitate gripping the jacket 22 to support the cup 23. In addition, larger ovoid openings 26 at opposite sides of the jacket 22 facilitate viewing the cup 23 and contents thereof when the cup 23 is mounted within the jacket 22.

Figure 18:
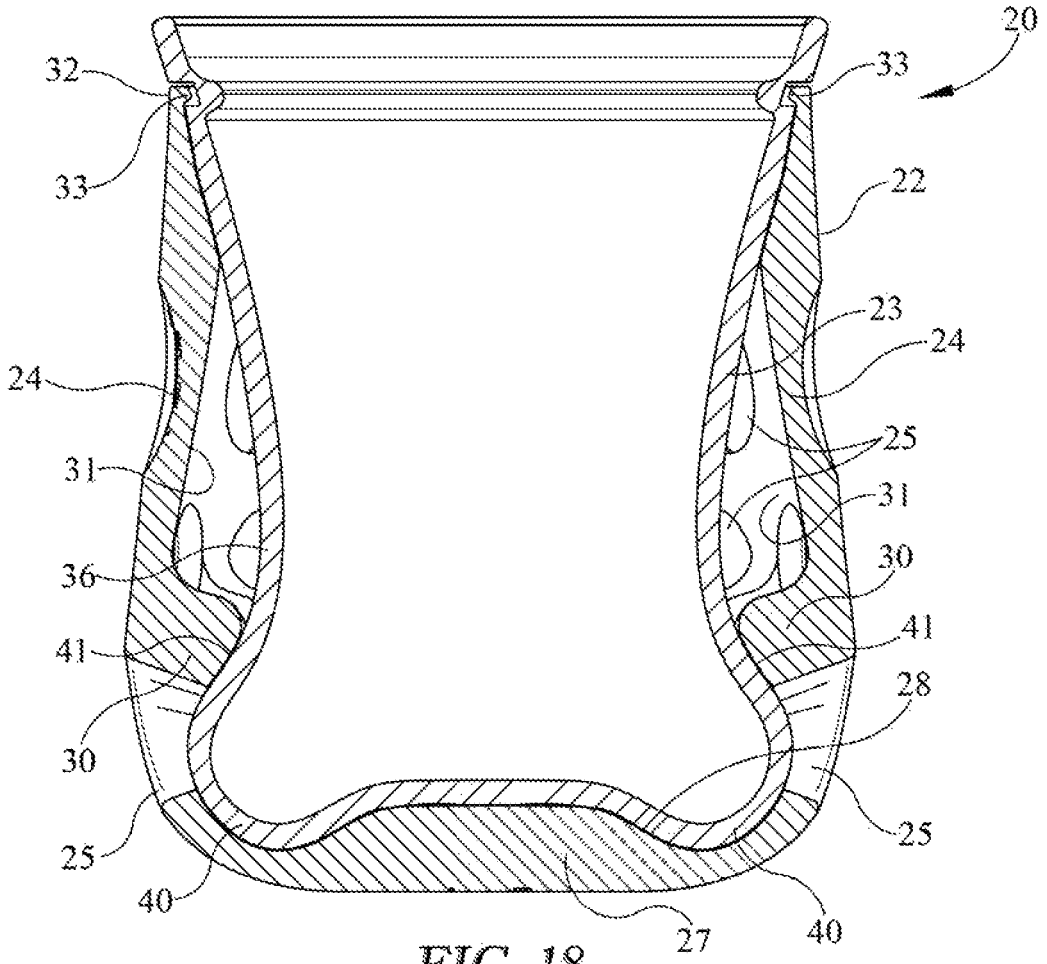
FIG. 18 is a sectional elevational view of the cup of FIG. 14 mounted within the container gripping aid of FIG. 10.

A bottom 27 of the jacket has an inner face 28 shaped to receive and snugly fit the cup 23. In addition, resilient spacer ribs 30 project inwardly from an inner face 31 of the side wall 24 of the jacket 22 to retain a side wall 24 of the jacket 22 spaced-apart from the cup 23, as best seen in FIG. 18. Further, a top rim 32 of the jacket 22 has an inwardly directed rib 33 for cooperation and snap engagement with the cup 23 to secure the cup 23 within the jacket 22.

Figure 10:
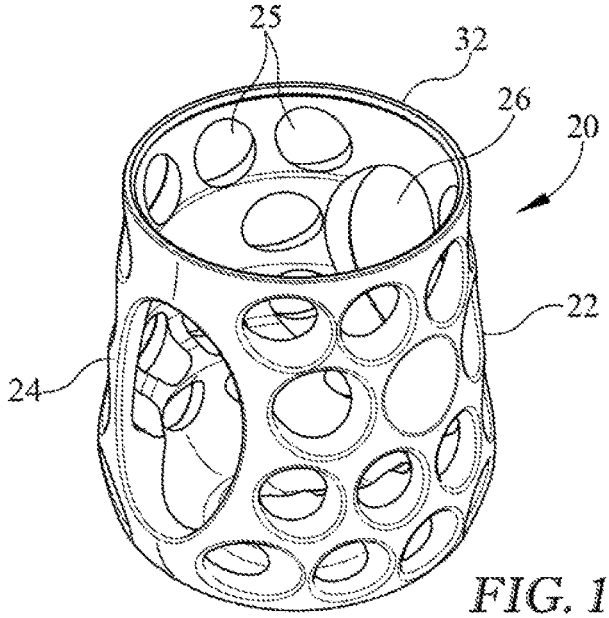
FIG. 10 is a perspective view of another container gripping aid according to the invention.
Figure 11:
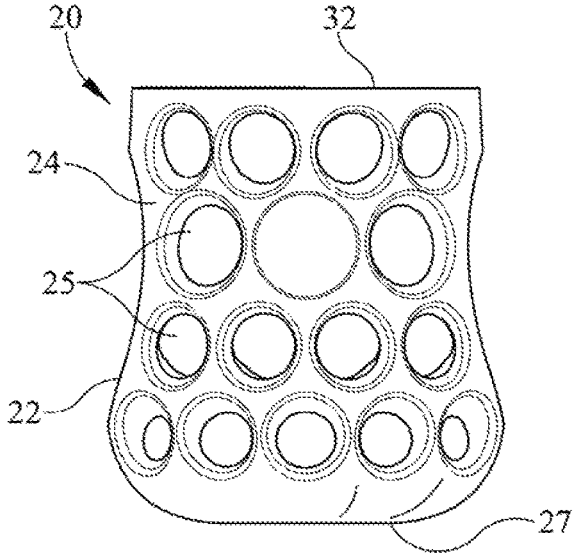
FIG. 11 is an elevational view of the container gripping aid of FIG. 10.
Figure 12:
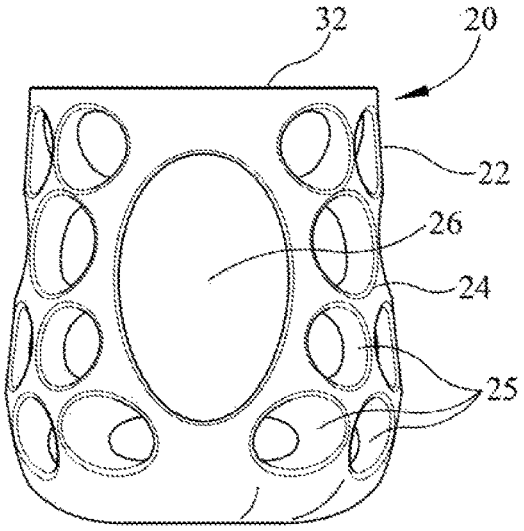
FIG. 12 is a side elevational view of the container gripping aid of FIG. 10.
Figure 13:
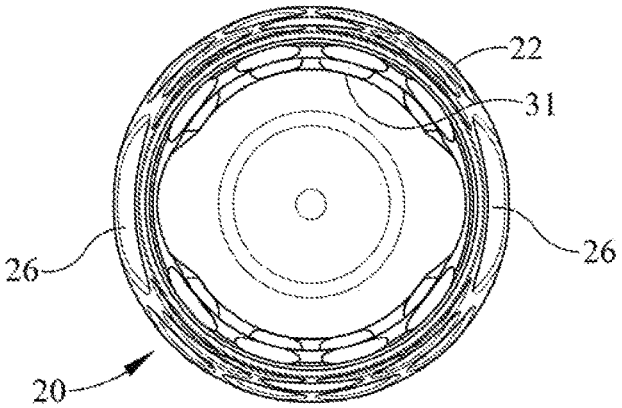
FIG. 13 is an underneath plan view of the container gripping aid of FIG. 10.

Referring in particular to FIGS. 14 to 17, there is shown the cup 23 for use with the container gripping aid 20 of FIG. 10. The cup 23 has a base 35 with an upstanding, generally concave, sidewall 36 terminating in an upper rim 37. Measurement indicia 39 for measuring the contents of the cup 23 may be provided on the side wall 36 and aligned in use with the large openings 26 in the jacket 22.

Located just below the rim 37 and spaced-apart therefrom is a circumferential slot or grove 38 for reception of the rib 33 at a rim 32 of the jacket 22. It will be noted that the resilient spacer ribs 30 on the inner face 31 of the jacket 22 will deflect to allow through passage of a bulbous bottom portion 40 of the cup 23. When the cup 23 is fully inserted into the jacket 23 the ribs 30 engage an upper shoulder 41 of the bottom portion 40 to securely retain the cup 23 in the jacket 22.

Figure 19:
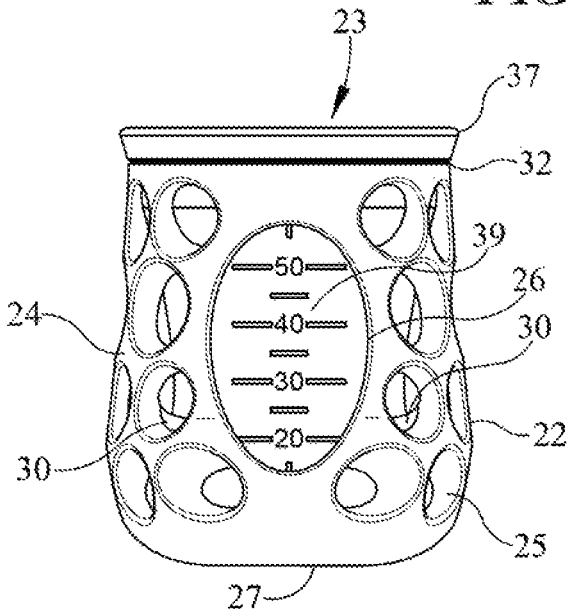
FIG. 19 is an elevational view of the cup and container gripping aid shown in FIG. 18.
Figure 20:
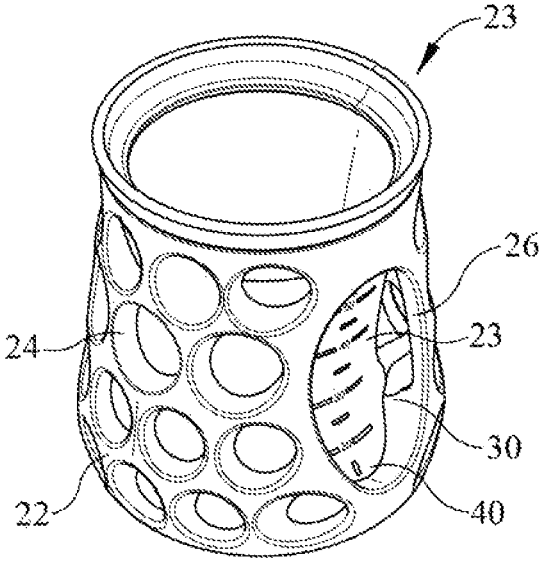
FIG. 20 is a perspective view of the cup and container gripping aid shown in FIG. 18.

FIGS. 18 to 20 show the cup 23 mounted within the container gripping aid 20 ready for use. The holes 25 in the jacket 22 allow a user to securely grip the jacket to support the cup 23.

The terms "comprise" and "include", and any variations thereof required for grammatical reasons, are to be considered as interchangeable and accorded the widest possible interpretation. Further, selected features of the various embodiments described may be combined in any desired combination to provide the gripping aid.

The invention is not limited to the embodiments hereinbefore described which may be varied in both construction and detail within the scope of the appended claims.

What is claimed is:

1. A container gripping aid configured for receiving a container of a type including a top, a bottom and an exterior side wall, the container gripping aid comprising:

a jacket sized and configured for reception of the container, the jacket having a mesh configuration, the jacket being resiliently deformable and being formed by a stiff but flexible material;

retaining means for securing the jacket in engagement with the container when the container is received in the jacket such that a side wall of the jacket is supported spaced-apart from the exterior side wall of the container, the retaining means comprising:

a pair of resiliently deformable opposed clamp arms which extend inwardly at a top of the jacket and are sized and configured for engagement with the top of the container when the container is received in the jacket; and a base support comprising an opposed pair of support arms which project inwardly at a bottom of the jacket and are sized and configured for engagement with the bottom of the container when the container is received in the jacket; and the jacket having means for gripping the jacket, the jacket gripping means comprising a plurality of perforations or through holes in the jacket to facilitate gripping the jacket when the container is received in the jacket.

2. The container gripping aid as claimed in claim 1 wherein the mesh configuration is formed by a plurality of circular holes in the jacket.

3. The container gripping aid as claimed in claim 1 wherein the jacket has a bulbous or egg-like shape.

4. The container gripping aid as claimed in claim 1 wherein each of the pair of resiliently deformable opposed clamp arms curves inwardly at the top of the jacket.

5. The container gripping aid as claimed in claim 1 wherein each of the opposed pair of support arms extends inwardly and upwardly at the bottom of the jacket.

6. The container gripping aid as claimed in claim 1 wherein each of the opposed pair of support arms is resiliently deformable.

7. The container gripping aid as claimed in claim 1 wherein the container is a baby bottle, and wherein the jacket is sized and configured to receive the baby bottle.

8. The container gripping aid as claimed in claim 7 wherein the container includes a shoulder proximate a top thereof, and wherein each of the pair of resiliently deformable opposed clamp arms is sized and configured to be engagable with the shoulder of the container when the container is received in the jacket.

9. A container gripping aid configured for receiving a container of a type including a top, a bottom and an exterior side wall, the container gripping aid comprising:

a jacket for reception of the container, the jacket having a mesh configuration, the jacket being resiliently deformable and being formed by a stiff but flexible material, and the jacket further including a plurality of perforations to facilitate gripping of the jacket;

a pair of resiliently deformable opposed clamp arms which extend inwardly proximate a top of the jacket for securing the jacket in engagement with the container such that a side wall of the jacket is supported spaced-apart from the exterior side wall of the container when the container is received in the jacket, the pair of resiliently deformable opposed clamp arms configured to engage the container proximate thea top of the container when the container is received in the jacket; and a base support comprising an opposed pair of support arms which project inwardly proximate a bottom of the jacket for engagement with the bottom of the container when the container is received in the jacket.

10. A combination, comprising:

a container including a top, a bottom and an exterior side wall; and a container gripping aid configured for receiving the container, the container gripping aid comprising:

a jacket for reception of the container, the jacket being resiliently deformable and having a mesh configuration with a plurality of holes to provide gripping means, the jacket having a bulbous shape such that when the jacket is engaged with the container most of a side wall of the jacket is supported spaced-apart from the exterior side wall of the container, a top of the jacket being engageable with the top of the container to secure the jacket in engagement with the container when the container is received in the jacket; and an opposed pair of resiliently deformable support arms disposed at a lower end of the jacket and projecting inwardly and upwardly at a bottom of the jacket for engagement with the base of the container when the container is received in the jacket.

* * * * *